US010047505B2

(12) United States Patent
Gong et al.

(10) Patent No.: US 10,047,505 B2
(45) Date of Patent: Aug. 14, 2018

(54) COOL WATER DRAINING SWITCH VALVE AND COMBINATION SHOWER HEAD

(71) Applicant: XIAMEN SOLEX HIGH-TECH INDUSTRIES CO., LTD., Xiamen, Fujian (CN)

(72) Inventors: Hailang Gong, Fujian (CN); Mingfu Zhang, Fujian (CN); Tianming Wang, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 0 days.

(21) Appl. No.: 15/392,881

(22) Filed: Dec. 28, 2016

(65) Prior Publication Data

US 2017/0362802 A1 Dec. 21, 2017

(30) Foreign Application Priority Data

Jun. 21, 2016 (CN) ..... 2016 1 0454322

(51) Int. Cl.

| | |
|---|---|
| ***A47K 3/00*** | (2006.01) |
| ***E03C 1/02*** | (2006.01) |
| ***E03B 1/04*** | (2006.01) |

(52) U.S. Cl.

CPC ..... *E03C 1/023* (2013.01); *E03B 1/048* (2013.01)

(58) Field of Classification Search

CPC ..... E03C 1/06
USPC ..... 4/615–618
See application file for complete search history.

(56) References Cited

U.S. PATENT DOCUMENTS 5,353,448 A * 10/1994 Lee ..... E03C 1/00 4/567
6,920,654 B2 * 7/2005 Noguchi ..... A47K 3/28 4/601

* cited by examiner

*Primary Examiner* — Lori Baker
(74) *Attorney, Agent, or Firm* — Rabin & Berdo, P.C.

(57) ABSTRACT

A cool water draining switch valve includes a valve body, a valve spool and a thermal module disposed in the valve body; the valve body has an inlet passage and a first outlet passage and a second outlet passage respectively connected to the inlet passage; the valve body is further disposed with a cool water draining passage connected to the inlet passage; the first outlet passage is connected to the cool water draining passage by a water draining hole, the second outlet passage is connected to the draining passage in unidirectional way by a check valve; a thermal port of the thermal module detects the water temperature of the draining passage, a retractable port of the thermal module opens or closes the water draining hole; when the valve spool is switched to a cool water draining mode, cool water in the inlet passage is drained to the draining passage.

12 Claims, 6 Drawing Sheets

COOL WATER DRAINING SWITCH VALVE AND COMBINATION SHOWER HEAD

FIELD OF THE INVENTION

The present invention relates to a cool water draining switch valve and a combination shower head.

BACKGROUND OF THE INVENTION

Cool water residual in the pipe needs to drain out before user gets shower, especially in winter. User can then get shower with warm water. Traditional technology to drain cool water out is by manual control, that is to say, the user needs to switch the valve to warm water to wait the cool water draining out, in some area, this process may need a few minutes; this method also needs the user using his hand to touch and test the water temperature and waits, otherwise he might get chilly; he needs to spend time on waiting, if he doesn't wait beside, hot water might be wasted. A switch valve with cool water draining function is disclosed in Chinese patent database with application number 20151135958.8, the switch valve is disposed with a cool water draining passage, cool water residual in the outlet waterway can drain out by the cool water draining passage by controlling the outlet waterway to connect to the cool water draining passage; when water flows out of the outlet waterway normally, the cool water draining passage is closed. To achieve above mentioned effect, a check valve and a reset spring are disposed to open and close the connection of the outlet waterway and the cool water draining passage. firstly, as the check valve is normal-close, the check valve is open by a certain suction force, the suction force needs to overcome the elastic force of the spring and the friction force of the check valve and the Y-ring; secondly, the direction of the suction force by Venturi effect is parallel to the moving direction of the check valve when draining cool water, but the section area is small, the action area of the suction force to the check valve is small, the downward force acted on the check valve is also small, if the force is smaller than a certain value, the check valve can not be open, cool water can not drain out of the showerhead waterway; thirdly, to increase the suction force, the proportion of the section area of the cool water draining passage and the mutation chamber is increased; to reduce the product size, it needs to reduce the section area of the cool water draining passage, resulting in low flowing area of the cool water draining mode and low flow volume and thus lengthened cool water draining time; Fourthly, as the friction force of the Y-rings and the side wall of the check valve are large, although there is restoring force of the spring, the check valve is difficult to reset; as the check valve can not perfectly reset, when the showerhead works, water will flow to the handheld showerhead through the air suction hole, resulting leakage of the handheld showerhead. In addition, when the handheld showerhead works, if the handheld showerhead has small volume outlet or water stop function, the pressure in the cool water draining passage would increase, water flowing through the handheld showerhead would flow to the showerhead from the air suction hole, resulting in leakage of showerhead. This kind structure is not reliable.

SUMMARY OF THE INVENTION

The present invention is provided with a cool water draining switch valve, which can drain out cool water residual in the two waterways at the same time, the structure is reliable.

The present invention is further provided with a combination shower head.

The technical solution of the present invention is that:

A cool water draining switch valve, comprising a valve body, a valve spool and a thermal module disposed in the valve body; wherein the valve body is disposed with an inlet passage and a first outlet passage and a second outlet passage respectively connected to the inlet passage; the valve body is further disposed with a cool water draining passage connected to the inlet passage; the first outlet passage is connected to the cool water draining passage by a water draining hole, the second outlet passage is connected to the cool water draining passage in unidirectional way by a check valve; a thermal port of the thermal module detects the water temperature of the cool water draining passage, a retractable port of the thermal module opens or closes the water draining hole;

when the valve spool is switched to the cool water draining passage, the first outlet passage and the second outlet passage are disconnected to the inlet passage, cool water in the inlet passage is drained to the cool water draining passage; residual cool water in the second outlet passage is absorbed by an absorb force to the cool water draining passage along the check valve; at the same time, the retractable port of the thermal module is retracted, the water draining hole is open, water drains out of the outlet of the first outlet passage through the water draining hole; when water temperature rises to a preset value, the retractable port of the thermal module extends out to close the water draining hole, the cool water draining is finished;

a normal-open non-return valve is disposed at a waterway defined between the second outlet passage and the cool water draining passage; when water flows to the second outlet passage from the inlet passage, the normal-open non-return valve disconnects the connection of the second outlet passage and the cool water draining passage under the action of a reverse water pressure; when water flows from the second outlet passage to the cool water draining passage, the normal-open non-return valve doesn't be influenced by external force and keeps in normal-open state.

In another preferred embodiment, the second outlet passage is disposed with a first outlet connected to the inlet passage and a second outlet connected to an inlet port of the check valve; the normal-open non-return valve is disposed between the first outlet and the second outlet.

In another preferred embodiment, the retractable port of the thermal module is linked to a sealing element, the retractable port drives the sealing element to move along the length direction of the retractable port.

In another preferred embodiment, the thermal module further comprises a reset element, the retractable port and the reset element are respectively disposed at two sides of the water draining hole and are coupled to clamp the sealing element.

In another preferred embodiment, the thermal module further comprises a shaft sleeve base, which is connected to the internal wall of the cool water draining passage in sealing way; the reset element and the sealing element are disposed in the shaft sleeve base.

In another preferred embodiment, the front end of the cool water draining passage is disposed with an accelerating passage, which is connected to the inlet passage; the water flowing area of the central portion of the accelerating passage is smaller than that of the two end portions, an outlet port of the check valve is connected to the rear portion of the accelerating passage.

A showerhead assembly, wherein comprising a showerhead, a handheld showerhead and the cool water draining switch valve;

the handheld showerhead is connected to the outlet of the first outlet passage, the showerhead is connected to the outlet of the second outlet passage.

Compared to the traditional technology, the present invention has following advantages:

1. The present invention is provided with a cool water draining switch valve that the check valve connects the second outlet passage and the cool water draining passage in one-way way; when the valve spool is switched to the cool water draining mode, water flows fast to the cool water draining passage, by Venturi effect, residual cool water in the second outlet passage is absorbed to the cool water draining passage along the check valve by an absorb force, the water finally flows out of the first outlet passage. Therefore, the inlet passage, the first outlet passage and the second outlet passage drain out cool water at the same time. After the cool water drains outlet, hot water flows out of the inlet passage; when the water temperature rises to a preset value, the retractable port of the thermal module closes the water draining hole to finish cool water draining, avoiding waste of water. At the same time, it avoids human being to test the water temperature, user can use hot water to get shower after the cool water is drained out without influenced by cool water. The cool water draining switch valve of the present invention is compact in structure, it can only dispose with a thermal module, the number of the functional components is few, the structure is simple, the cost is low.

2. The cool water draining switch valve of the present invention is provided that, with the check valve, water in the cool water draining passage would not flow reversely to the second outlet passage.

3. The cool water draining switch valve of the present invention is provided that a normal-open non-return valve is disposed between the first outlet and the second outlet; when water flows from the second outlet passage to the cool water draining passage, the normal-open non-return valve keeps the second outlet in open state without any external force. When water flows from the inlet passage to the second outlet passage, the normal-open non-return valve closes the second outlet by the water pressure in reverse direction, avoiding water flowing to the cool water draining passage from the second outlet.

4. The cool water draining switch valve of the present invention is provided that with the independent check valve and non-return valve, the second outlet passage can be connected to and disconnected to the cool water draining passage, when the second outlet passage outlets water, the second outlet passage is disconnected to the cool water draining passage, water would not flow to the cool water draining passage.

5. As the normal-open non-return valve is normal-open, residual water in the second outlet passage easily drains out of the cool water draining passage under the suction force by Venturi effect; the suction force by Venturi effect can just overcome the elastic force of the check valve, therefore, the suction force is little, therefore, the inlet area difference of the cool water draining mode can be made small, the section area proportion of the cool water draining passage and the mutation chamber can be made small, such that the section area of the cool water draining passage can be enlarged, largely increasing the cool water draining volume and shortening the cool water draining time.

DETAILED DESCRIPTION OF THE EMBODIMENTS

The present invention will be further described with the drawings and the embodiments.

Embodiment 1

Figure 1:
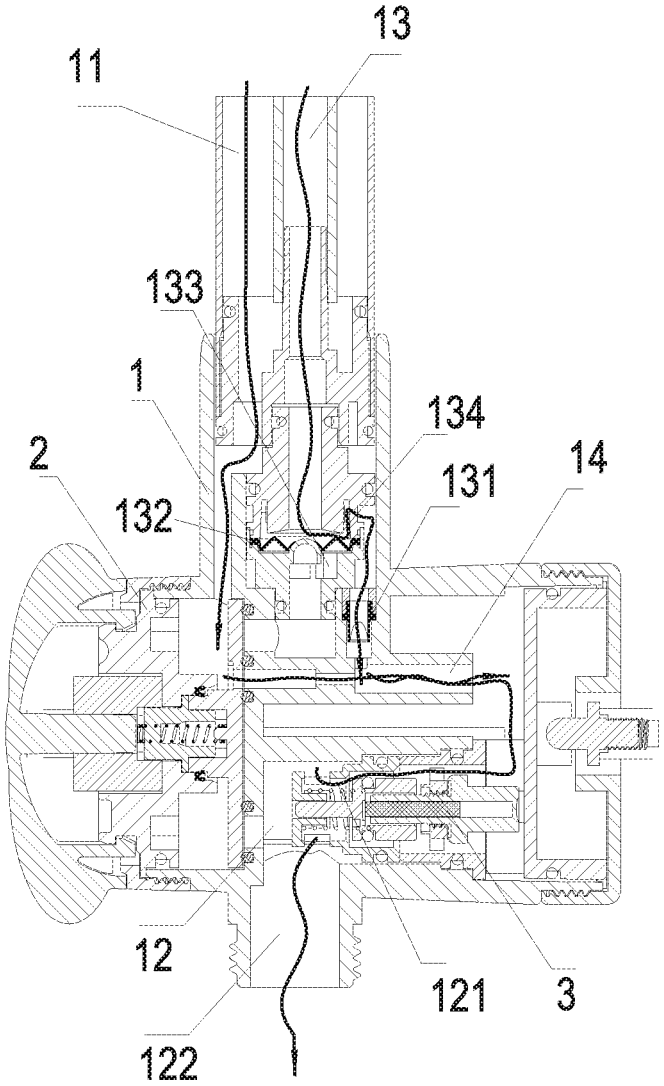
FIG. 1 illustrates a sectional diagram of a cool water draining switch valve with waterway in cool water draining mode of Embodiment 1 of the present invention.
Figure 2:
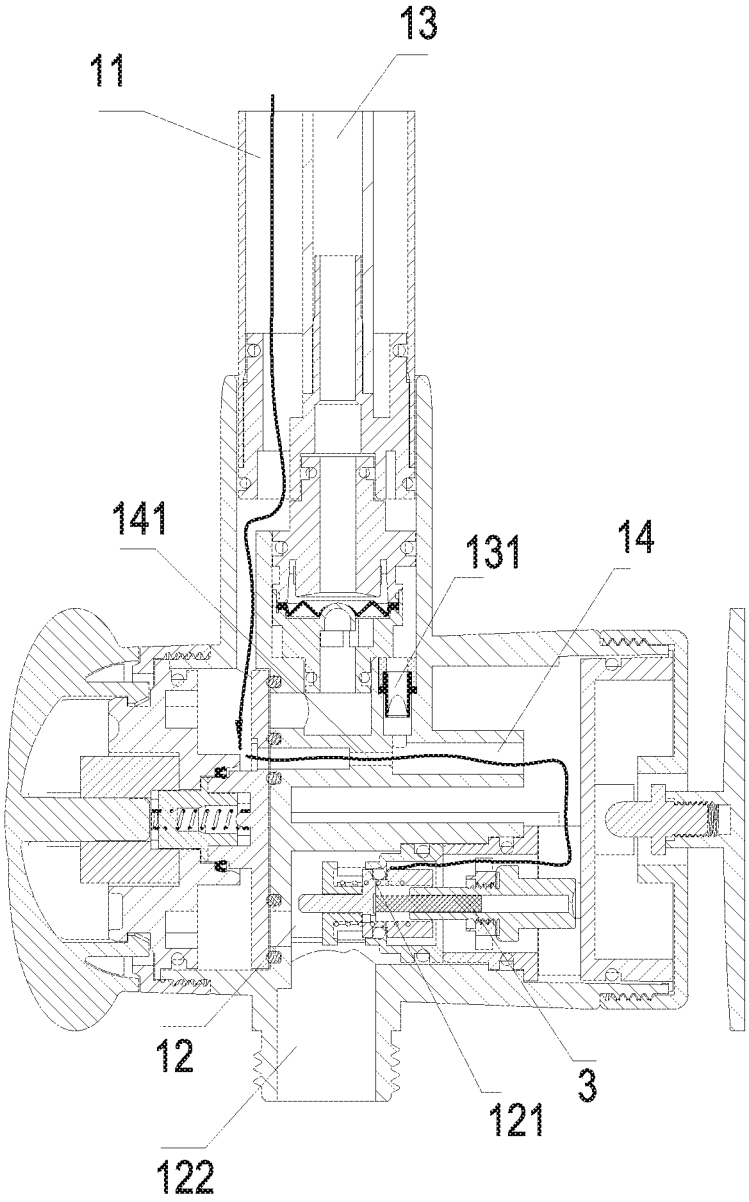
FIG. 2 illustrates a sectional diagram of the cool water draining switch valve with waterway after cool water draining of Embodiment 1 of the present invention.
Figure 3:
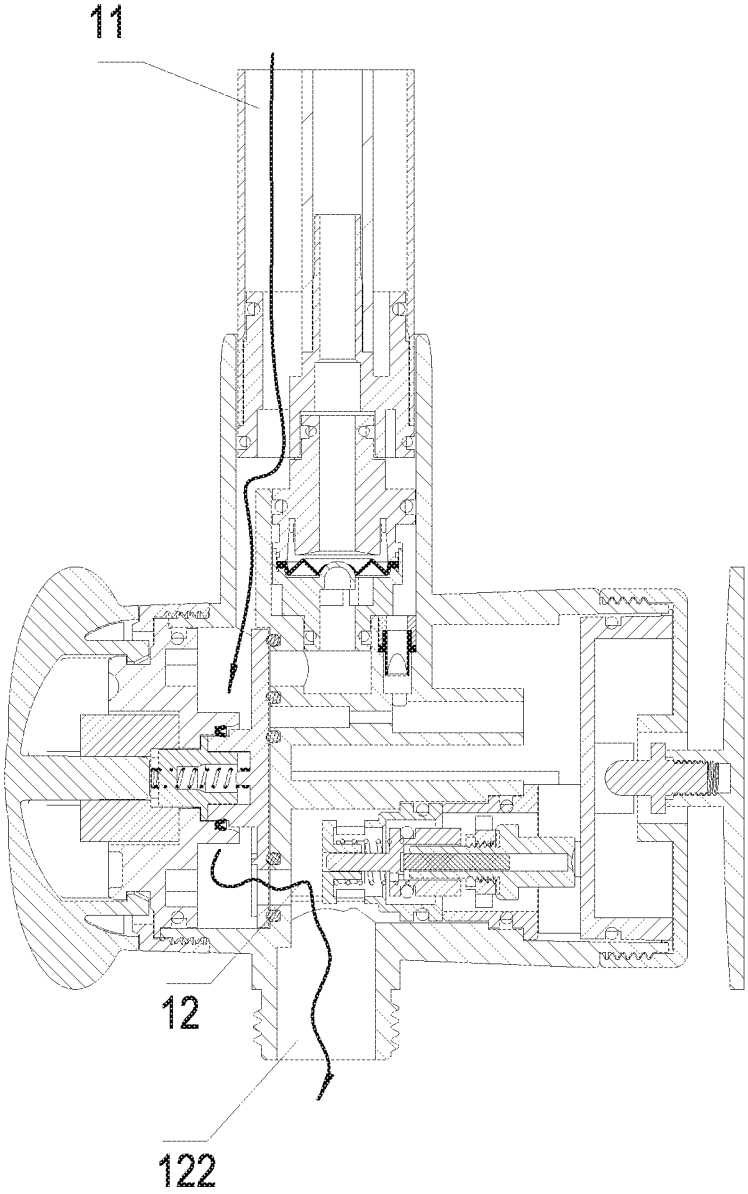
FIG. 3 illustrates a sectional diagram of the cool water draining switch valve switched to the first outlet passage of Embodiment 1 of the present invention.
Figure 4:
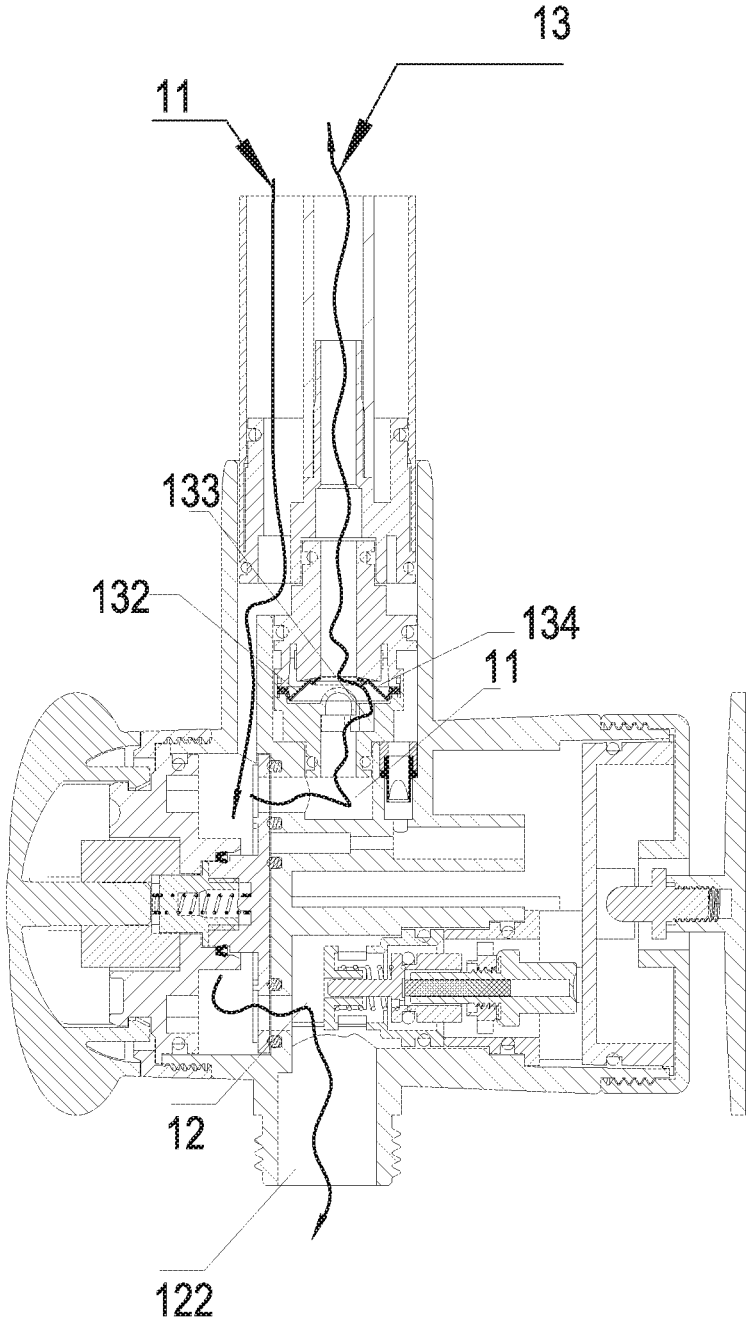
FIG. 4 illustrates a sectional diagram of the cool water draining switch valve switched to mixing water outlet of Embodiment 1 of the present invention.
Figure 5:
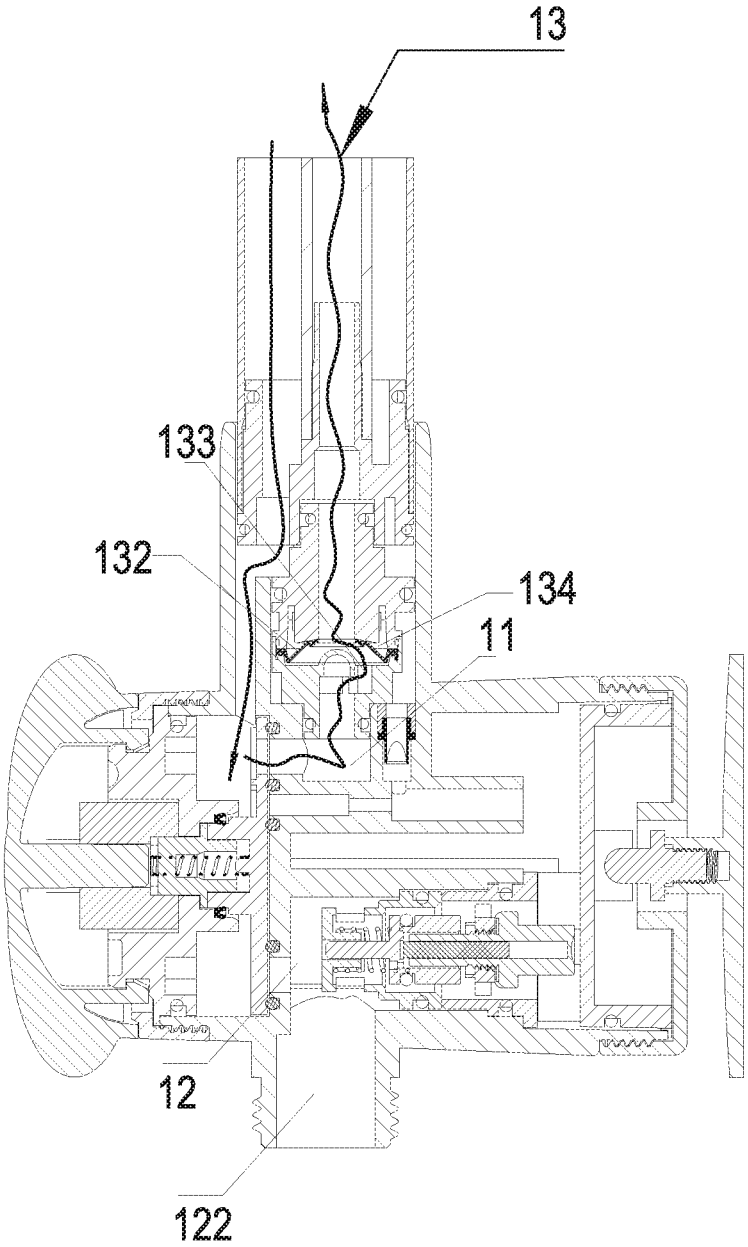
FIG. 5 illustrates a sectional diagram of the cool water draining switch valve switched to the second outlet passage of Embodiment 1 of the present invention.
Figure 6:
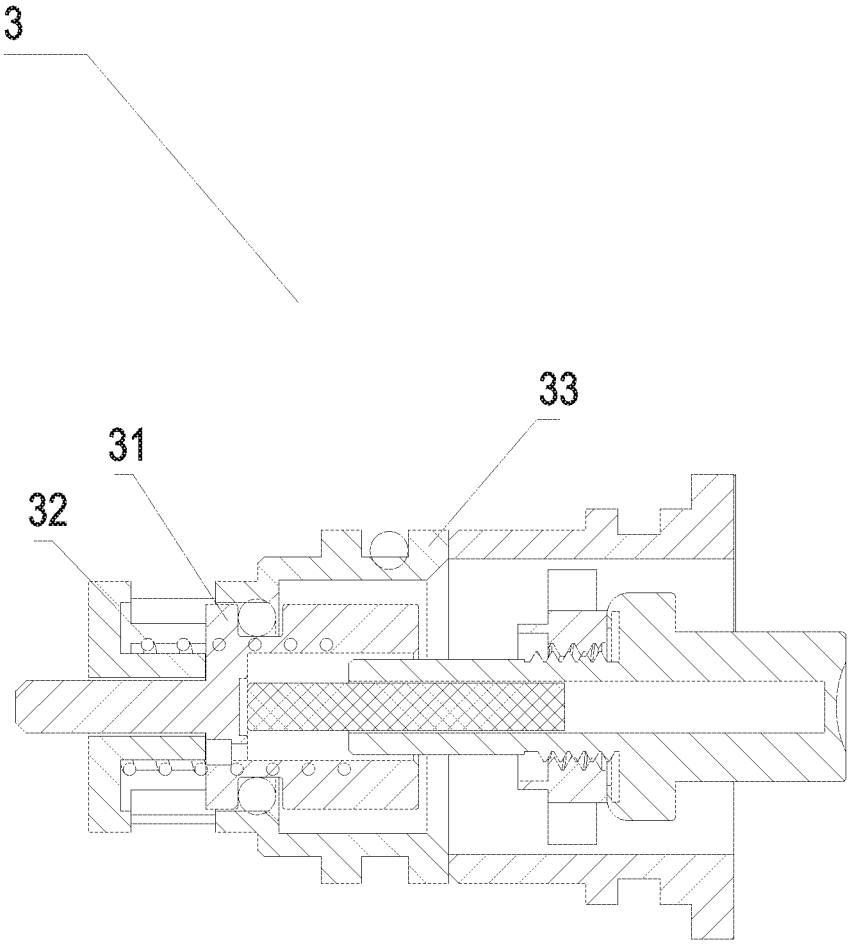
FIG. 6 illustrates a sectional diagram of a thermal module of Embodiment 1 of the present invention.

Referring to FIGS. 1-6, a cool water draining switch valve, comprising a valve body 1, a valve spool 2 and a thermal module 3 disposed in the valve body 1;

the valve body 1 is disposed with an inlet passage 11 and a first outlet passage 12 and a second outlet passage 13 respectively connected to the inlet passage 11; the valve body 1 is further disposed with a cool water draining passage 14 connected to the inlet passage 11; the first outlet passage 12 is connected to the cool water draining passage 14 by a water draining hole 121, the second outlet passage 13 is connected to the cool water draining passage 14 in unidirectional way by a check valve 131; a thermal port of the thermal module 3 detects the water temperature of the cool water draining passage 14, a retractable port of the thermal module 3 opens or closes the water draining hole 121;

the valve spool 2 comprises a cool water draining mode, a first outlet waterway and a second outlet waterway.

When the valve spool 2 is switched to the cool water draining mode, the first outlet passage 12 and the second outlet passage 13 are disconnected to the inlet passage 11, cool water in the inlet passage 11 is drained to the cool water draining passage 14; when water passes by the outlet of the check valve 131, an absorb force is generated to absorb the residual cool water in the second outlet passage 13 to the cool water draining passage along the check valve 131; at the same time, the retractable port of the thermal module 3 is retracted, the water draining hole is open, water drains out of the outlet 122 of the first outlet passage 12 through the water draining hole; when water temperature rises to a preset value, the retractable port of the thermal module 3 extends out to close the water draining hole 121, the cool water draining is finished.

Therefore, the present invention realizes the inlet passage 11, the first outlet passage 12 and the second outlet passage 13 drain cool water outlet at the same time. When the cool water drains out and hot water flows out of the inlet passage 11, the water temperature rises to the preset value, the retractable port of the thermal module extends out to close the water draining hole 121, the cool water draining is finished, avoiding waste of water. At the same time, it avoids human being to test the water temperature, user can use hot water to get shower after the cool water is drained out without influenced by cool water. In addition, with the check valve 131, water in the cool water draining passage 14 would not flow reversely to the second outlet passage 13.

A normal-open non-return valve 132 is disposed at a waterway defined between the second outlet passage 13 and the cool water draining passage 14; the normal-open non-return valve 132 is normal-open if there is no external force, that is to say, the second outlet passage 13 keeps connected to the cool water draining passage 14. when the valve spool 2 is switched to the cool water draining passage, residual water in the second outlet passage 13 can flow to the cool water draining passage 14 freely; when the valve spool 2 is switched to the second outlet passage 13 to outlet water, water flows to the second outlet passage 13 from the inlet passage 11, the normal-open non-return valve 132 disconnects the connection of the second outlet passage 13 and the cool water draining passage 14 under the action of a reverse water pressure.

Therefore, when the valve spool 2 is switched to the second outlet passage 13 to outlet water, water doesn't flow to the cool water draining passage 14 due to the non-return valve 132, thus ensuring the stability of the whole switch valve.

In a detailed structure: the second outlet passage 13 is disposed with a first outlet 133 connected to the inlet passage 11 and a second outlet 134 connected to an inlet port of the check valve 131; the normal-open non-return valve 132 is disposed between the first outlet 133 and the second outlet 134. With this configuration, when the normal-open non-return valve 132 is open, the second outlet passage 13 is connected to the cool water draining passage by the second outlet 134; when the normal-open non-return valve 132 is closed, the second outlet passage 13 is connected to the inlet passage 11 by the first outlet 133.

The retractable port of the thermal module 3 is linked to a sealing element 31, the retractable port drives the sealing element 31 to move along the length direction of the retractable port. When the retractable port of the thermal module 3 extends out, the sealing element 31 closes the water draining hole 121.

The thermal module 3 further comprises a reset element 32, the retractable port and the reset element 32 are respectively disposed at two sides of the water draining hole 121 and are coupled to clamp the sealing element 31. When the retractable port extends out, the reset element 32 is compressed, when the retractable port is retracted, the resilience force of the reset element 32 drives the sealing element 31 to reset to open the water draining hole 121.

The thermal module 3 further comprises a shaft sleeve base 33, which is connected to the internal wall of the cool water draining passage 14 in sealing way; the reset element 32 and the sealing element 31 are disposed in the shaft sleeve base 33.

The front end of the cool water draining passage 14 is disposed with an accelerating passage 141, which is connected to the inlet passage 11; the water flowing area of the central portion of the accelerating passage 141 is smaller than that of the two end portions, an outlet port of the check valve 131 is connected to the rear portion of the accelerating passage 141. Therefore, the water flowing through the accelerating passage is accelerated, improving the Venturi effect. when water passes by the outlet of the check valve 131, an absorb force is generated to absorb the residual cool water in the second outlet passage 13 to the cool water draining passage along the check valve 131

Embodiment 2

This embodiment is provided with a showerhead assembly, which comprises a showerhead, a handheld showerhead and the cool water draining switch valve according to Embodiment 1;

the handheld showerhead is connected to the outlet of the first outlet passage, the showerhead is connected to the outlet of the second outlet passage.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A cool water draining switch valve, comprising:

a valve body including an inlet passage, a first outlet passage and a second outlet passage respectively connected to the inlet passage, and a cool water draining passage connected to the inlet passage, connected to the first outlet passage by a water draining hole, and connected to the second outlet passage in unidirectional way by a check valve;

a valve spool disposed in the valve body; and a thermal module disposed in the valve body, having a thermal port that detects water temperature of the cool water draining passage, and having a retractable port that opens and closes the water draining hole, and a normally-open non-return valve disposed in a waterway defined between the second outlet passage and the cool water draining passage, wherein, when the valve spool is switched to a cool water draining mode, the first outlet passage and the second outlet passage are disconnected from the inlet passage, cool water in the inlet passage is drained to the cool water draining passage, wherein, when water passes by an outlet of the check valve, residual cool water in the second outlet passage is absorbed into the cool water draining passage along the check valve, and, at the same time, the retractable port of the thermal module is retracted, the water draining hole is opened, water drains out of the outlet of the first outlet passage through the water draining hole, wherein, when water temperature rises to a preset value, the retractable port of the thermal module extends out to close the water draining hole, and cool water draining is finished, and wherein, when water flows to the second outlet passage from the inlet passage, the normally-open non-return valve disconnects the connection of the second outlet passage and the cool water draining passage under action of a reverse water pressure; when water flows from the second outlet passage to the cool water draining passage, the normally-open non-return valve is not influenced by external force and maintains a normally-open state.

2. The cool water draining switch valve according to claim 1, wherein the second outlet passage is disposed with a first outlet connected to the inlet passage and a second outlet connected to an inlet port of the check valve, and wherein the normally-open non-return valve is disposed between the first outlet and the second outlet.

3. The cool water draining switch valve according to claim 1, wherein the retractable port of the thermal module is linked to a sealing element, and the retractable port drives the sealing element to move along a length direction of the retractable port.

4. The cool water draining switch valve according to claim 3, wherein the thermal module further comprises a reset element, and the retractable port and the reset element are respectively disposed at two sides of the water draining hole and are coupled to clamp the sealing element.

5. The cool water draining switch valve according to claim 4, wherein the thermal module further comprises a shaft sleeve base connected to an internal wall of the cool water draining passage in a sealing way, and the reset element and the sealing element are disposed in the shaft sleeve base.

6. The cool water draining switch valve according to claim 1, wherein the cool water draining passage has a front end that is disposed with an accelerating passage connected to the inlet passage, wherein the accelerating passage has two end portions, a rear portion, and a central portion having a water flowing area that is smaller than that of the two end portions, and wherein the check valve has an outlet port that is connected to the rear portion of the accelerating passage.

7. A showerhead assembly, comprising;

a showerhead;

a handheld showerhead; and the cool water draining switch valve according to claim 1, wherein the handheld showerhead is connected to the outlet of the first outlet passage, and the showerhead is connected to the outlet of the second outlet passage.

8. A showerhead assembly, comprising;

a showerhead;

a handheld showerhead; and the cool water draining switch valve according to claim 2, wherein the handheld showerhead is connected to the outlet of the first outlet passage, and the showerhead is connected to the outlet of the second outlet passage.

9. A showerhead assembly, comprising;

a showerhead;

a handheld showerhead; and the cool water draining switch valve according to claim 3, wherein the handheld showerhead is connected to the outlet of the first outlet passage, and the showerhead is connected to the outlet of the second outlet passage.

10. A showerhead assembly, comprising;

a showerhead;

a handheld showerhead; and the cool water draining switch valve according to claim 4, wherein the handheld showerhead is connected to the outlet of the first outlet passage, and the showerhead is connected to the outlet of the second outlet passage.

11. A showerhead assembly, comprising;

a showerhead;

a handheld showerhead; and the cool water draining switch valve according to claim 5, wherein the handheld showerhead is connected to the outlet of the first outlet passage, and the showerhead is connected to the outlet of the second outlet passage.

12. A showerhead assembly, comprising;

a showerhead;

a handheld showerhead; and the cool water draining switch valve according to claim 6, wherein the handheld showerhead is connected to the outlet of the first outlet passage, and the showerhead is connected to the outlet of the second outlet passage.

* * * * *